United States Patent [19]

Erickson

[11] Patent Number: 4,854,954

[45] Date of Patent: Aug. 8, 1989

[54] RECTIFIER LIQUID GENERATED INTERMEDIATE REFLUX FOR SUBAMBIENT CASCADES

[76] Inventor: Donald C. Erickson, 1704 So Harbor Ln., Annapolis, Md. 21401

[21] Appl. No.: 195,089

[22] Filed: May 17, 1988

[51] Int. Cl.[4] ..... F25J 3/04

[52] U.S. Cl. ..... 62/22; 62/28; 62/38

[58] Field of Search ..... 62/22, 28, 38

[56] References Cited

U.S. PATENT DOCUMENTS

| | | | |
|---|---|---|---|
| 2,779,174 | 1/1957 | Vesque | 62/175.5 |
| 4,357,153 | 11/1982 | Erickson | 63/34 |
| 4,433,989 | 2/1984 | Erickson | 62/22 |
| 4,533,375 | 8/1985 | Erickson | 62/22 |
| 4,604,116 | 8/1986 | Erickson | 62/22 |
| 4,605,427 | 8/1986 | Erickson | 62/30 |
| 4,670,031 | 6/1987 | Erickson | 62/22 |
| 4,705,548 | 11/1987 | Agrawal et al. | 62/22 |

*Primary Examiner*—Ronald C. Capossela

[57] ABSTRACT

The invention discloses process and apparatus for increasing the efficiency of subambient cascaded .fractional distillations such as air separation, ethane-ethylene separation, or nitrogen rejection from natural gas. The improvement provides an advantageous means of generating the optimal amount of intermediate reflux liquid for both rectifications in the cascade. Referring to Figure 4, a latent heat exchanger (415) is provided in which a liquid from the HP rectifying section (403) of the cascade exchanges latent heat with a minor fraction of the feed gas. The condensed feed is then split by two valves (409 and 410) into respective intermediate reflux streams for both parts of the cascade (402 and 403).

40 Claims, 11 Drawing Sheets

RECTIFIER LIQUID GENERATED INTERMEDIATE REFLUX FOR SUBAMBIENT CASCADES

TECHNICAL FIELD

This invention relates to processes and apparatus for the subambient fractional distillation of fluid mixtures. The described improvement increases the energy efficiency of the distillation and hence reduces the amount of vapor compression necessary to power the distillation and/or pressurize the products. Subambient fractional distillation is used for air separation, natural gas liquids extraction, nitrogen and/or helium rejection from natural gas, $CO_2$ removal, ethane-ethylene separation, and in other industrial separation processes.

BACKGROUND ART

Many subambient fractional distillations employ a cascade configuration, in which a higher pressure rectification section reboils (exchanges latent heat with) a lower pressure distillation column, and also supplies liquid overhead reflux to the lower pressure column. Thus the driving force for the distillation is provided by pressurizing at least part of the feed to the higher rectification pressure. This provides energy efficiency advantages over the alternative approach—use of an external heat pump to drive a column. The advantages are owing to avoidance of the pressure loss and heat leakage associated with compressing the heat pump vapor, removing the compression heat via ambient cooling, and recycling the compressed vapor back to the cold distillation column.

Although it has long been known that intermediate refluxing of a rectifying section can potentially make the rectification more efficient, and also that increases in distillation efficiency are more important in subambient distillations which are driven by mechanical energy, as distinct from above-ambient distillations which are driven by lower value thermal energy, nevertheless there has been only minimal prior use of intermediate refluxing in subambient distillations. It can be hypothesized that two factors contribute to this situation: first, that in order to realize the full benefit of intermediate refluxing, or indeed any benefit at all, it is necessary provide a fairly precise flowrate of intermediate reflux, relative to the flowrates of the column feed and the overhead reflux. Specifically, the intermediate reflux flowrate should be adjusted so as to obtain a "pinch" (a near-approach between operating line and equilibrium line on the McCabe-Thiele diagram) at the intermediate reflux height at the same time that pinches are also achieved at the feed height and the overhead reflux height. Secondly, there has historically been a difficulty in cascade distillations (also referred to as "dual pressure" or "doubler distillations") in obtaining any amount of intermediate reflux at all, let alone the very narrowly defined optimal quantity.

In the field of cryogenic air distillation, three means have previously been disclosed for obtaining intermediate reflux liquid (liquid air) in a cascade arrangement, with the liquid air subsequently being divided into separate intermediate reflux streams for both the high pressure (HP) rectifier and the low pressure (LP) distillation column.

In one method, disclosed in U.S. Pat. NO. 4670031, the liquid oxygen bottom product from the low pressure column is evaporated at above LP column pressure by exchanging latent heat with about 28% of the supply air, while essentially totally condensing the air.

In a second method a minor fraction of the supply air is totally condensed so as to reboil the LP column bottom, as disclosed in co-pending application 010332 filed Feb. 3, 1987 by Donald C. Erickson now U.S. Pat. No. 4,769,055.

In a third method a minor fraction of the supply air is cooled and then work-expanded to a pressure intermediate to the HP rectifier pressure and the LP column pressure, so as to produce refrigeration, and is then totally condensed against evaporating kettle liquid which is depressurized to the approximate LP column pressure. This method is disclosed in co-pending application 946484 filed Dec. 24, 1986 by Donald C. Erickson now U.S. Pat. No. 4,777,803.

In all three of the above applications it is further possible to additionally compress the minor air fraction en route to total condensation to above the supply pressure, and also to use the expansion work to provide at least part of the additional compression.

The problems with the above three disclosed means of providing intermediate reflux liquid are that the amount of liquid air produced in each instance is dictated by some objective other than obtaning the optimal quantity of intermediate reflux liquid. In the first method, typically some 28% of the supply air must be totally condensed to evaporate about 20.5% of the air as $O_2$ product. In the second method, some 20 to 24% of the supply air is typically condensed to provide the appropriate quantity of LP column bottom reboil. In the third method, only about 8 to 12% of the air need be expanded and totally condensed to provide the desired refrigeration. In contrast, the optimum distillation efficiency of both the HP rectifier and the LP column rectifying section is achieved when between about 8 and 20% of the supply air is totally condensed and split between the columns; and most optimally (depending upon process variables) about 14%.

The third technique ("AIRPER") overlaps into the optimal range but has the disadvantage of also requiring a liquid air pump.

What is needed, and one objective of this invention, is a means of providing intermediate liquid reflux (totally condensed feed vapor) in optimal amounts (so as to cause the triple pinch condition desired) to both the HP-rectifying section and LP column of a cascaded subambient distillation, while at the same time deriving maximum benefit from the total condensation step.

In many subambient distillations, and increasingly in air distillation, substatial quantities of more than one product are desired. For example, in many oxygen-production processes a substantial quantity of pressurized nitrogen is also desired. One direct benefit of providing optimal intermediate reflux liquid, and another objective of this invention, is the coproduction of the maximum possible amount of pressurized co-product for a given input of compression energy. In one embodiment, another objective of the disclosed invention is to produce at least part of the co-product at a pressure which is actually higher than the supply pressure.

DISCLOSURE OF INVENTION

The above and other useful objectives are obtained by providing process and/or apparatus for subambient fractional distillation of a compressed and cooled feed mixture by a high pressure (HP) rectification step cascaded with a low pressure distillation step wherein a minor fraction of the feed vapor, preferably at a pressure at least as high as the HP rectification pressure, is essentially totally condensed to liquid feed by exchanging latent heat with a liquid derived from said HP rectification step, and then the condensed feed is split into at leat two streams, one for intermediate height refluxing of said HP rectification step, and the other for intermediate height refluxing of said LP distillation step.

Within the above generic description of the invention are possible two embodiments depending upon which HP rectification liquid exchanges latent heat with the totally condensing feed vapor; overhead liquid or bottom liquid.

The embodiment wherein bottom liquid exchangers latent heat with totally condensing feed vapor has two sub-embodiments, dependent upon whether the vapor generated thereby is returned to the HP rectifier or routed elsewhere. The sub-embodiment wherein the vapor generated thereby is returned to the rectification section is of particular interest. Of even more interest is the embodiment wherein said latent heat exchanging step includes a zone of counter-current vapor-liquid contact, thereby maximizing the further enrichment of the bottom liquid beyond the concentration possible from rectification alone. However, it will be recognized that this embodiment requires that the minor fraction of feed vapor to be totally condensed must first be compressed a small amount above the feed supply pressure (HP rectifier pressure).

In the embodiment wherein HP rectifier overhead product exchanges latent heat with the totally condensing feed, there are also further sub-embodiments possible, dependent on whether the overhead liquid being evaporated is at, above, or below HP rectifier pressure. In that group of embodiments, a cascaded subambient distillation process and/or apparatus is provided wherein at least part of the feed is rectified at high pressure; the rectified feed is distilled at a lower pressure; the distilling step is reboiled by exchanging latent heat with vapor from the rectifying step; the distilling step is refluxed with liquid overhead product from the rectifyng step; and wherein a minor fraction of the feed vapor is totally condensed by exchanging latent heat with liquid overhead product from said rectifying step; and the condensed feed is split into at least two streams for respective intermediate height refluxing of both said rectifying step and said distilling step.

BRIEF DESCRIPTION OF THE DRAWINGS

FIGS. 1 and 2 illustrate embodiments wherein the minor feed fraction is totally condensed against HP rectifier overhead liquid, and FIGS. 3 and 4 illustrates feed total condensation against HP rectifier bottom liquid. In FIG. 3 the latent heat exchange step is conducted in a separate enclosure, whereas in FIG. 4 the latent heat exchange step also incorporates a counter-current vapor-liquid contact step, and both functions are incorporated in the same pressure vessel which contains the HP rectifier.

The remaining figures, although still highly simplified schematic flowsheets, additionally illustrate some of the practical features which become necessary or desirable when a specific feed material (e.g., air) is input and a specific product slate is desired. FIG. 6 depicts a low energy triple pressure configuration having only minimal $N_2$ coproduct capability, and the remaining figures depict more conventional dual pressure configurations wherein the additional energy input as supply air compression energy is realized as substantial quantities (10 to 25%) of pressurized $N_2$. The distinctions between these flowsheets are found in which rectifier liquid is evaporated to cause total condensation of the minor fraction of feed, the pressure at which the total condensation occurs, and which vapor streams, if any, are expanded or additionally compressed. —FIG. 12 is for low purity oxygen, and FIG. 13 is for nitrogen production.

BEST MODE FOR CARRYING OUT THE INVENTION

Figure 1:
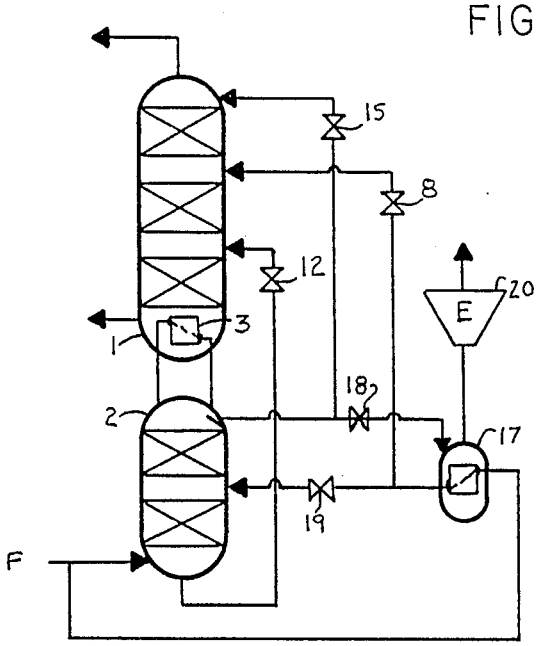
FIGS. 1 through 4 illustrate the essentials of four generic embodiments of the disclosed invention.

Referring to FIG. 1, pressurized feed vapor is split into major and minor streams, and the major stream, cooled to near its dewpont, is fed to HP rectifier 2 for rectification into overhead product liquid and bottom liquid. The rectifier 2 is refluxed by reflux condenser 3, which is also a reboiler for LP column 1. Rectifier 2 bottom liquid is depressurized by means for depressurization 2 (e.g., a valve) and fed to LP column 1. Rectifier 2 overhead product liquid is split into two streams, one of which is routed to reflux the overhead of LP column 1 through means for depressurization 15, and the other is routed to overhead product (OP) evaporator 17 via valve 18. OP evaporator 17 may preferably operate at slightly above rectifier 2 pressure due to liquid hydrostatic pressure.

The minor feed fraction is routed to OP evaporator 17 where it is essentially totally condensed, and then the condensed feed is split into two intermediate reflux streams, one for LP column 1 via means for depressurization 8, and the other for rectifier 2 via valve 19. Pressurized gaseous overhead product is withdrawn from OP evaporator 17, and may optionally be work-expanded to produce refrigeration in expander 20. Remaining overhead product is withdrawn from the overhead of column 1, and bottom product from the sump of column 1.

Figure 2:
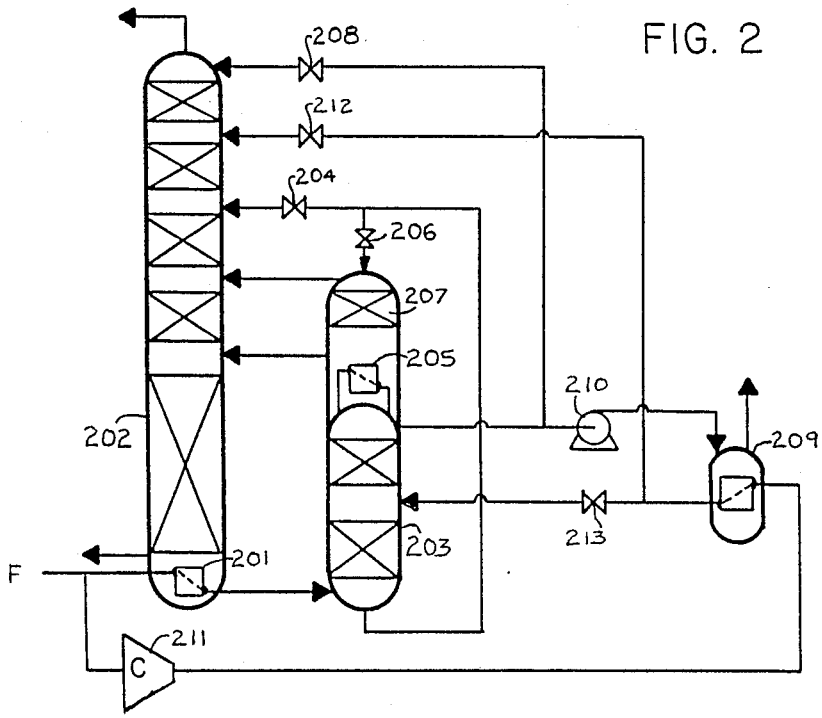

In addition to the conventional cascade configuration of FIG. 1, the generic inventive entity is also applicable to the "nested" cascade configuration of FIG. 2, i.e., cascades in which there is some temperature overlap between the rectifier and the LP column. In FIG. 2, the major feed fraction is routed to partial condenser 201 which reboils the bottom of LP column 202 while partially condensing the feed, and then the partially condensed feed is supplied to HP rectifier 203. Bottom liquid from rectifier 203 is fed to LP column 202 via valve 204, and/or is fed to reflux condenser 205 via valve 206. Condenser 205 may optionally have associated with it a zone of counter-current vapor-liquid contact 207, such that evaporation by condenser 205 results in two vapor streams of differing composition which are fed to different heights of column 202. Overhead liquid from condenser 205 of rectifier 203 is split into two streams, one for overhead refluxing of column 202 via valve 208, and the other for supply to OP evaporator 209 via pump 210 or other means for pressurization.

The minor fraction of feed vapor is additionally compressed beyond the pressure of the remaining feed in compressor 211, and (after optional cooling) is essentially totally condensed in OP evaporator 209. Condensed feed is then split into respective intermediate height reflux streams for LP column 202 via valve 212 and for HP rectifier 203 via valve 213. Pressurized OP vapor is withdrawn from evaporator 209, and overhead product vapor is withdrawn from column 202 overhead.

Figure 3:
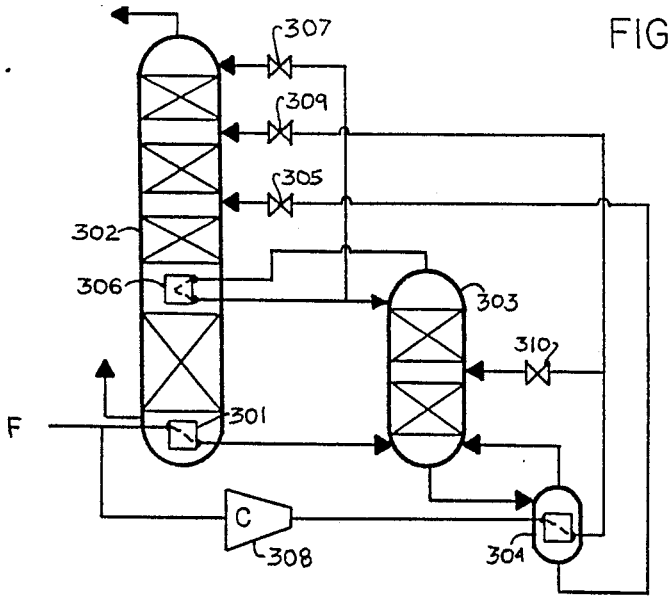

In FIG. 3, also a nested cascade arrangement, the major feed fraction is partially condensed in reboiler 301 of LP column 302 and then fed to HP rectifier 303. Bottom liquid from rectifier 303 is routed to evaporator 304 where it is partially evaporated and the vapor is preferably returned to rectifier 303. The further enriched bottom liquid is then fed to column 302 via valve 305, although it will be realized that the feeding could also be done via multiple paths including partial evaporation as in FIG. 2. Absent that, rectifier 303 is refluxed via condenser 306 which is also an intermediate height reboiler for column 302. Overhead product liquid from reflux condenser 306 is used to reflux column 302 via valve 307. The minor feed fraction is additionally compressed in compressor 308, essentially totally condensed in evaporator 304, and then split into respective intermediate height reflux streams for column 302, via valve 309, and for rectifier 303 via valve 310.

Figure 4:
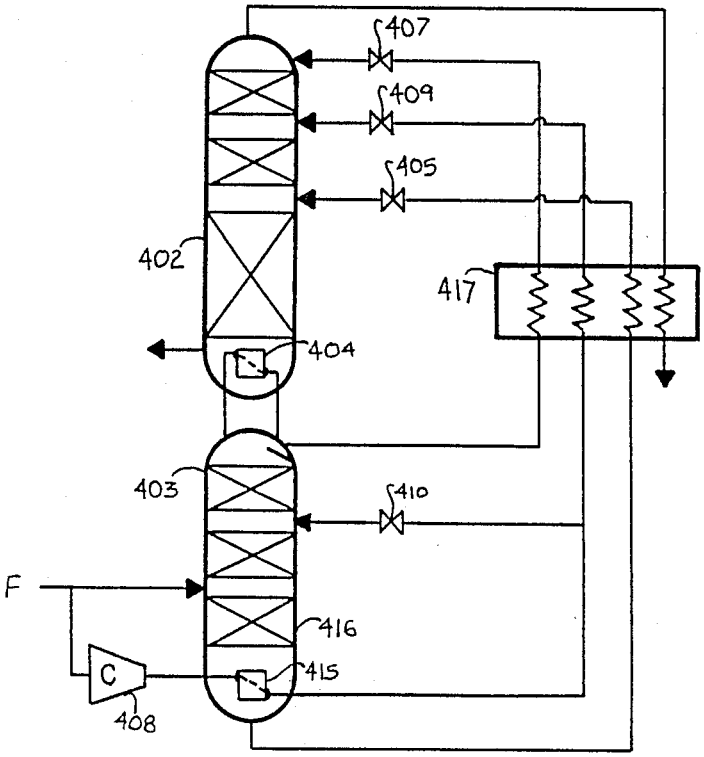

In FIG. 4, the major feed fraction is routed to column 403 which is comprised of a rectifier above the feed height, and also incorporated a bottom liquid partial evaporator 415 and associated zone of counter-current vapor-liquid contact 416 below the feed height. In other words, the external evaporator 304 of FIG. 3 has been moved inside the column, and a zone of fluid contact has been added. It will be recognized that either evaporator 415 alone or both it and contact zone 416 could be located externally without changing the basic function—further enrichment of the bottom liquid beyond what is possible with rectification alone, and also beyond what is possible with heat exchange alone (for a given heat duty). The minor feed fraction is additionally compressed in compressor 408 and essentially totally condensed in partial evaporator 415. Condensed feed is split into two streams, one for intermediate height refluxing of the rectifying section of column 403 via a valve 410, and the other for intermediate height refluxing of LP column 402 via valve 409. LP column 402 is reboiled by reboiler 404 which is also the reflux condenser for HP column 403. Column 403 overhead product liquid is routed via valve 407 to reflux the overhead of LP column 402. Preferably all of the liquid feed and reflux streams enroute to LP column 402 are sensibly cooled in heat exchanger 417 against LP column overhead product vapor.

In both FIGS. 3 and 4, the additional enrichment of HP rectifier bottom liquid, accomplished in evaporators 304 and 415 respectively, makes possible increased column efficiency resulting in a greater yield of high pressure overhead product. However, the full potential increase in pressurized overhead product yield is only realized if the amount of intermediate reflux supplied to each column, and hence the total amount of feed condensed in said evaporators, is regulated so as to achieve a simultaneous pinch condition at the feed height(s), the two intermediate reflux heights, and the respective overheads. The increased yield of pressurized overhead product may be realized as net product directly or may be used to supply additional overhead reflux to the two columns thereby increasing the effective bottom product yield, or may be expanded to provide more refrigeration, or put to any other useful purpose. The added capital cost is relatively minor: a few additional stages or trays of countercurent vapor-liquid contact, an additional heat exchanger (evaporator), and a small compressor (which may be driven directly by the refrigeration expander).

Figure 5:
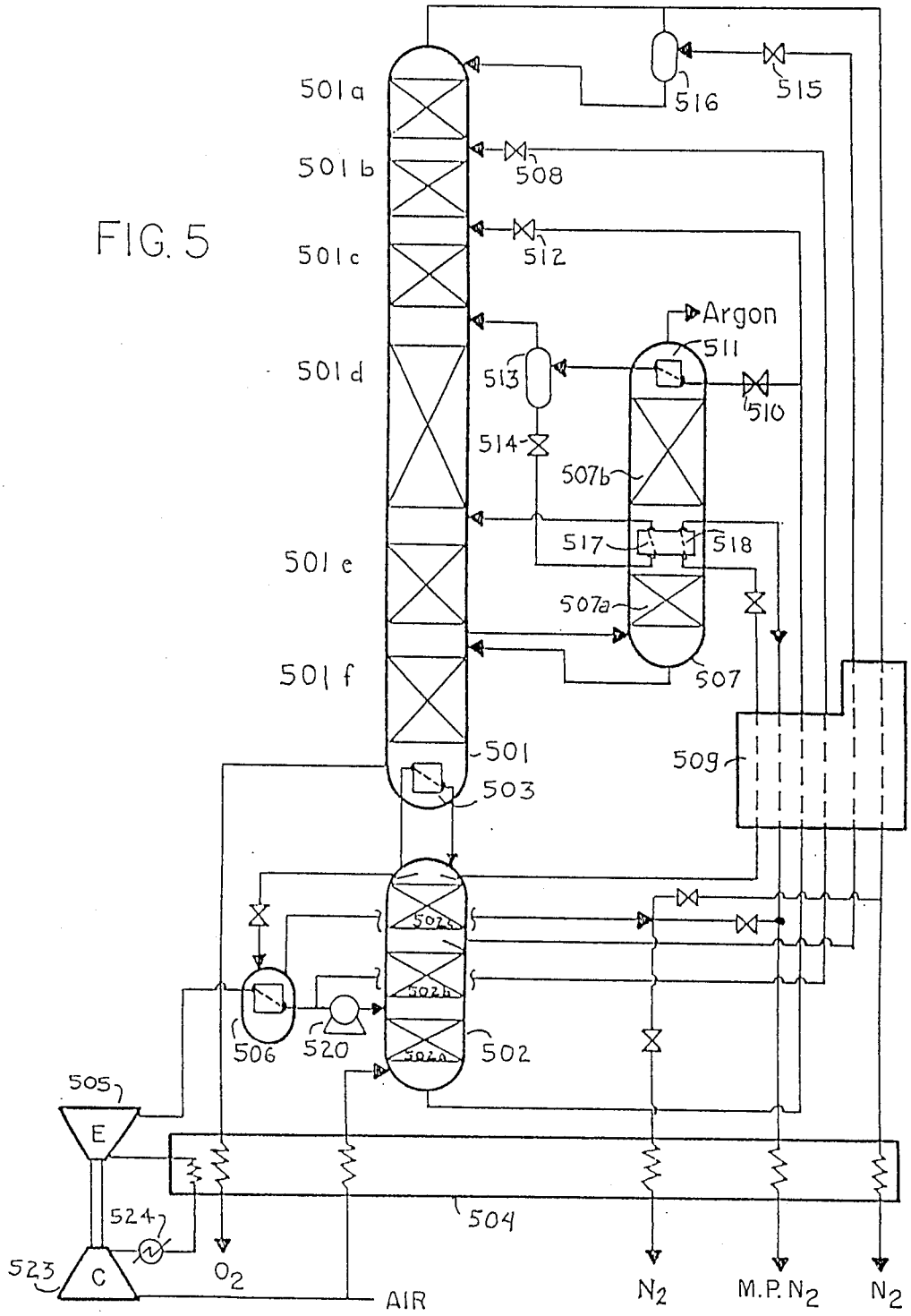
FIGS. 5 through 11 illustrate the production of high purity $O_2$, crude argon, and additionally pressurized $N_2$ and/or liquid product.

Referring to FIG. 5, the compressed and cleaned supply air, at a pressure in the approximate range of 4 to 6 ATA (atmospheres absolute), is divided into major and minor streams, the latter consisting of about 8 to 21% of the total flow, and at least the major stream is cooled in main heat exchanger 504 to near its dewpoint and then fed to HP rectifier 502 as vapor. The feed air is rectified in rectifier 501 to $LN_2$ overhead product and kettle liquid (oxygen-enriched liquid) bottom product. Reboiler/reflux condenser 503 refluxes rectifier 502 and reboils low pressure column 501 via latent heat exchange. Rectifier 502 incorporates zones of countercurrent vapor-liquid contact **502*a* and 502*b*, which are separated by an intermediate reflux height appropriate for liquid air reflux. Liquid $N_2$ containing up to about 1% impurities is withdrawn from above zone 502*b*, subcooled in cooler 509, depressurized by control valve 515, and then fed to the overhead of column 501 as reflux. The flash vapor may first be removed in optional phase separator 516. Kettle liquid from rectifier 502 is also cooled in cooler 509 and then split into two streams, one for direct feed to LP column 501 via control valve 512, and the other for indirect feed to column 501 via at least partial evaporation. Control vave 510 directs the latter stream to overhead reflux condenser 511 of argon rectifier 507, which is part of LP column 501, i.e., a "sidearm". Vapor from condenser 511 is fed to column 501 between contact zones 501*c* and 501*d*, and at least part of the remaining unevaporated liquid from condenser 511 is separated n optional phase separator 513 and routed via control valve 514 to intermediate height reflux condenser 517, situated between contact zones 507*a* and 507*b*. Vapor from condenser 517 is fed to column 501 between contact zones 501*d* and 501*e*, i.e., at a lower height than the vapor from condenser 511**.

Thus, the rectifier 501 bottom product is fed to three different heights of the $N_2$ removal section of column 501, contact zones **501*a* through 501*e*. The oxygen-argon mixture produced at the bottom of contact zone 501*e* is further distilled to high purity (99.5%) oxygen and crude argon (~95% purity) by argon stripper 501*f* and sidearm 507, which are integral parts of composite LP column 501. Product high purity $O_2$ is withdrawn from the sump of column 501** as either vapor or liquid (or a combination).

Figure 6:
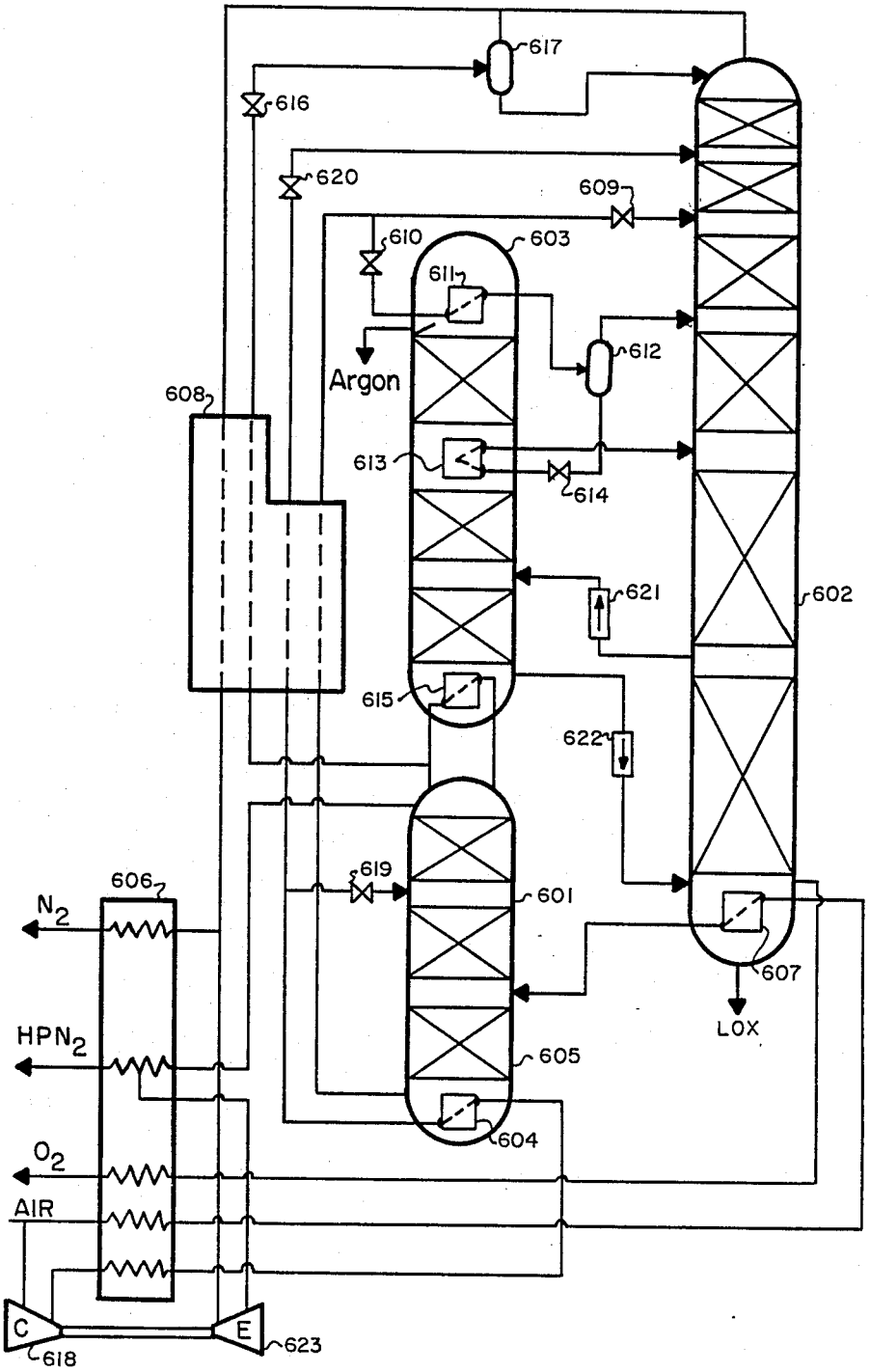

Referring to FIG. 6, a "triple pressure" cryogenic air distillation configuration is depicted, comprised of column 601, which incorporates the HP rectification section; LP column 602; and argon-oxygen separation column 603, which operates at a pressure slightly lower than LP column 602, e.g., a 1 ATA as opposed to 1.3 ATA. Column 601 incorporates total condenser 604 in which a minor fraction of the supply air is totally condensed, and also a zone of counter-current vapor-liquid contact, stripping section 605. The major fraction of cleaned and compressed supply air is cooled in main heat exchanger 606 to near its dewpoint, then partially condensed in reboiler 607 so as to reboil column 602, and then fed to column 601 for rectification and for further enrichment via stripper 605 and condenser 604. The bottom liquid from column 601 is cooled in sensible heat exchanger 608, then split into preferably two or more streams, one for direct feed to column 602 via valve 609, and the other for indirect feed to column 602 by first being used to reflux column 603, thereby being at least partially evaporated. The latter stream is reduced in pressure by valve 610, partially evaporated in reflux condenser 611, phase separated in separator 612, and at least part of the remaining liquid is supplied to intermediate reflux condenser 613 via valve 614. The vapor streams from separator 612 and condenser 613, being of different composition, are fed to different heights of column 602. Column 601 is refluxed by reflux condenser 615, which also reboils column 603. Column 601is refluxed by reflux condenser 615, which also reboils column 603. Column 601 overhead liquid product is cooled in heat exchanger 608, reduced in pressure by valve 616, phase separated in separator 617, and then used to reflux column 602. The minor fraction of supply air (about 8 to 20%, and preferably about 14%9 destined for total condenser 604 is first additionally compressed by compressor 618 and cooled by heat exchanger 606. The condensed feed is split into at least two intermediate reflux streams, one for rectifying section of column 601 via valve 619, and the other for column 602 via valve 620 after cooling in heat exchanger 608. Liquid oxygen-argon feed mixture for column 603 is withdrawn from an intermediate height of column 602 below the lowest feed height, and is controlled by means for one-way flow control 621, for example a check valve. Liquid oxygen bottom product from column 603 is transferred to the higher pressure sump of column 602 via means for one-way flow control 622, preferably using the hydrostatic head of the column of liquid oxygen (approximately 3 to 4 meters) to achieve the increase in pressure. Partial condenser 607 incorporates sufficient duty to evaporate the bottom product high purity oxygen (at least 99% purity) from both columns 602 and 603, as well as to reboil column 602. Frequently it will also be desirabl to withdraw a small liquid oxygen (LOX) stream, e.g., to recover krypton and xenon values. Crude argon (approximately 95% purity) is withdrawn from the overhead of column 603 as either a vapor or a liquid, most preferably as a liquid which is pressurized by hydrostatic head before being evaporated at above atmospheric pressure. Process refrigeration may be conventionally provided via either air or nitrogen expansion, preferably the latter in expander 623. It is also preferred that expander 623 directly power compressor 618, since the available power is almost exactly the amount required to raise the condensing temperature of 14% of the supply air by the necessary 3 to 4 K, and thus a single rotating apparatus supplies both duties. In overview, the "total condensation-rectifier reboil-liquid air split into two optional intermediate reflux streams" (TCRR-LAIRSPLIT) as described in FIG. 6 provides not only full recovery (~20.5%) of high purity $O_2$ (~99.5%) at column 602 pressure (~1.3 ATA) coupled with approximately 75% recovery of crude argon, all of which has been achieved in earlier disclosures, but this disclosure also makes possible the recovery of about 2% high pressure $N_2$ coproduct, either directly as vapor or as added duty in expander 623 so as to enable some liquid coproduct (e.g., LIN or LOX). All of this is accomplished with an air supply pressure of less than about 4.4 ATA—a unique and highly advantageous result.

Referring to FIGS. 7 through 11, several different embodiments of the invention are described as applied to dual pressure high purity $O_2$ production with argon sidearm for crude argon recovery. Prior art flowsheets have already disclosed achievement of full $O_2$ recovery under PC LOXBOIL or companded TC LOXBOIL conditions coupled with about 75% crude argon recovery. Hence once again the primary reason for incorporatin total condensation of rectifier liquid for optional intermediate refluxing ("TCRL/LAIRSPLIT") is to increase the recovery of pressurized $N_2$, for any useful purpose.

Figure 7:
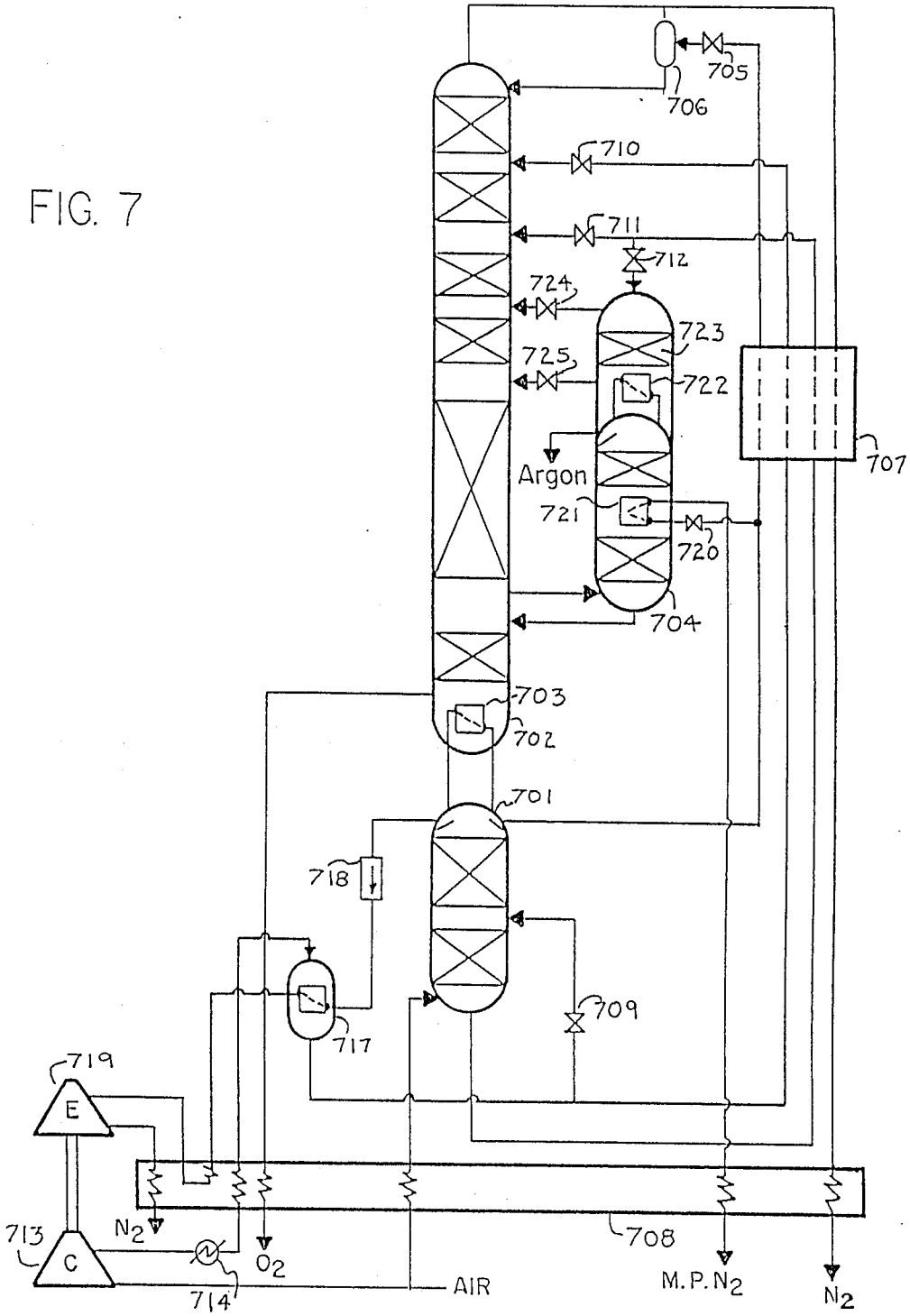

Referring to FIG. 7, a cascade configuration is provided comprised of HP rectifier 701, LP column 702, and interconnecting reboiler/reflux condenser 703. Column 702 als incorporates argon sidearm 704. Rectifier 701 overhead liquid refluxes column 702 overhead via valve 705 and optional phase separator 706, after subcooling in sensible heat exchanger 707. Main heat exchanger 708 is used to cool supply air against exiting vapor streams. Liquid air is split into respective intermediate height reflux streams for rectifier 701 via valve 709 and for column 702 via valve 710. Liquid feed to column 702 is preferably split into one fraction for direct feed through valve 711, and another fraction for indirect feed accompanied by at least partial evaporation through valve 712. It will be understood, however, that alternatively all of the feed liquid could be supplied through valve 711 and the overhead of sidearm 704 could be refluxed by alternative means, e.g., by direct exchange of latent heat with column 702 intermediate height liquid. The minor air fraction is additionally compressed in compressor 713 and preferably cooled in cooler 714.

Figure 8:
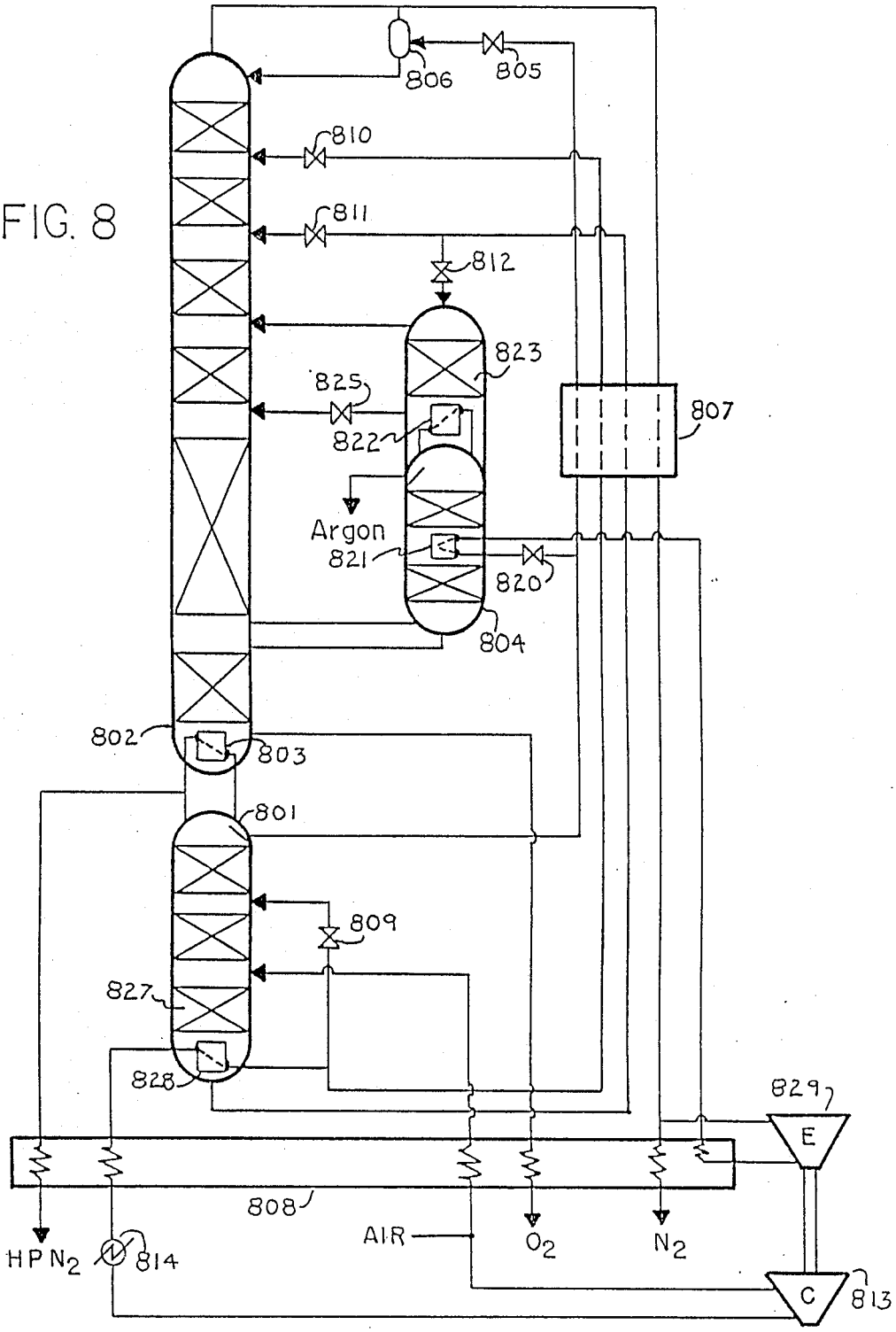

The above description also applied to FIGS. 8 through 11, with each 7XX-series numered component renumbered the corresponding number in the series of each figure number, i.e., component 701 of FIG. 7 corresponds to component 801 of FIG. 8. The remaining description will only describe the differences between the several figures.

In FIG. 7, the major air fraction is routed directly to rectifier 701 after cooling. Part of rectifier 701 overhead LIN is routed to LIN evaporator 717 via means for increasing pressure one-way flow control 718, and evaporated by the totally condensing minor air fraction. If the hydrostatic head is high enough, component 718 can be simply a check valve, but otherwise it will be a LIN pump. Gaseous $N_2$ from evaporator 717, at higher pressure than rectifier 701, can be withdrawn as product, and/or can be at least partially expanded as shown in expander 719. The expander power is preferably used to power compressor 713. When product $O_2$ is evaporated at heat exchanger 703 as illustrated in FIG. 7, then substantially more overhead LIN will be available from rectifier 701 than is necessary to reflux column 702 and to supply evaporator 717, and the excess may be supplied through valve 720 to evaporator 721 which refluxes argon sidearm 704. Although evaporator 721 may be located at the overhead of sidearm 704, by locating it at an intermediate height as shown and adding a few trays above it there is no reduction in argon recovery or purity and the LIN is evaporated at higher pressure, e.g., 3.3 ATA, when the air supply pressure is about 5.3 ATA and column 702 pressure is about 1.3 ATA. Most preferably, evaporator 721 pressure would be matched to expander 719 exit pressure, with the combined stream of about 24% of the supply air flowrate being $N_2$ product at medium pressure. Sidearm 704 is refluxed at the overhead by reflux condenser 722, which together with contact zone 723 and control valves 724 and 725 converts the kettle liquid from valve 712 into two fluid streams of differing composition for feeding to different heights of column 702.

Referring to FIG. 8, the major supply air fraction is directly supplied to the rectifying section of column 801, and the rectifier bottom liquid is further enriched by contact zone 827 and supply air total condenser 828 ("TCFR"). Some HP rectifier 801 $N_2$ is withdrawn directly as product (up to about 13% of the supply air flow) and medium pressure $N_2$ evaporated in evaporator 821 is partially wormed and then work-expanded in expander 829.

Figure 9:
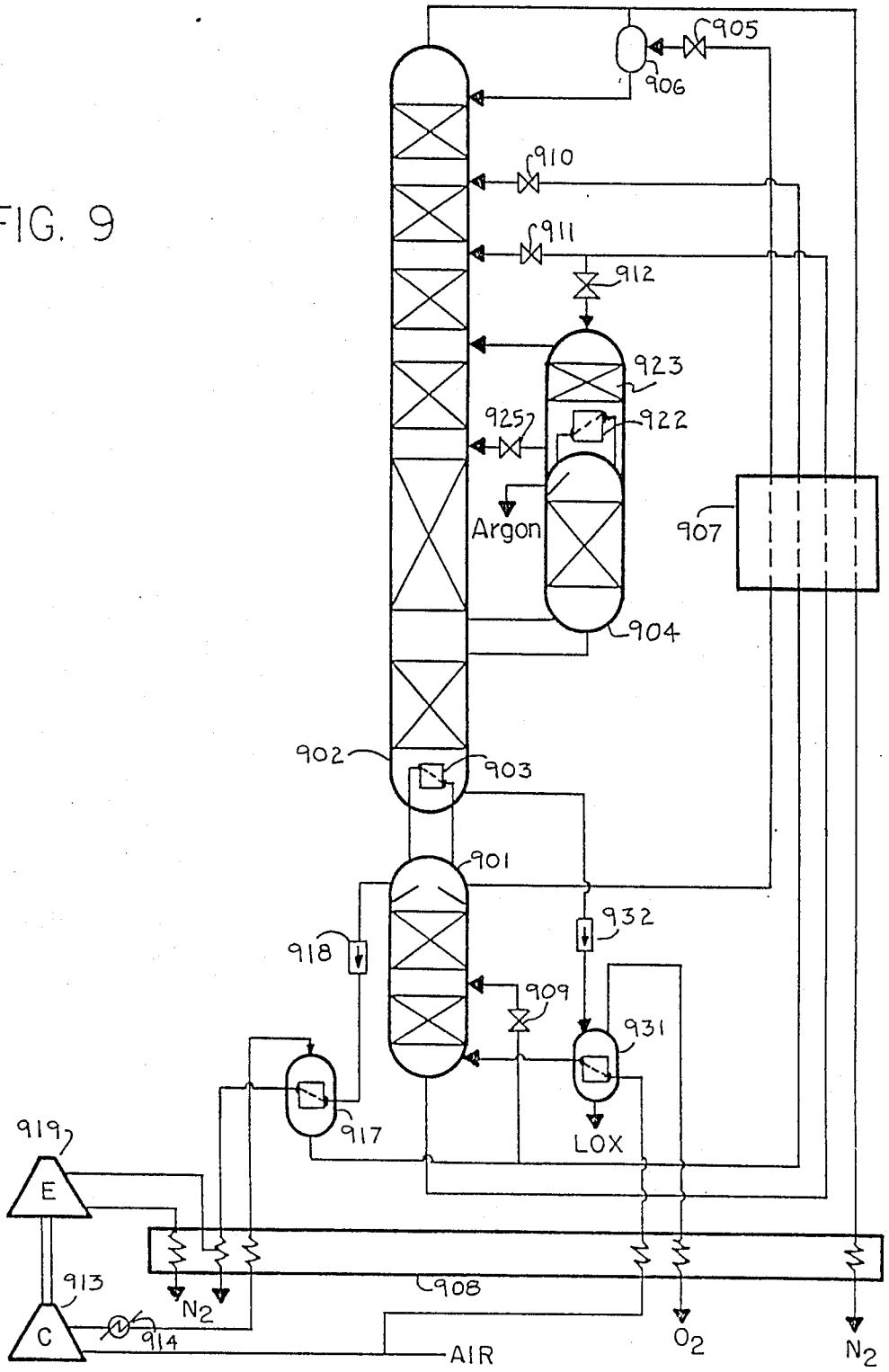

Referring to FIG. 9, the major fraction of supply air is first partially condensed in LOXBOIL evaporator 931 which evaporates product oxygen at above column 902 pressure, and then the partially condensed air is supplied to rectifier 901. The liquid oxygen is raised to evaporator 931 pressure by LOX pressurizer 932, which may be a hydrostatic leg plus check valve or a pump. Since $O_2$ evaporation is via PC LOXBOIL, there is not enough excess LIN to supply both LIN evaporator 917 and also an intermediate reflux condenser for sidearm 904, and hence, one is deleted, e.g., the latter. Thus, the FIG. 9 flowsheet supplies pressurized $O_2$ product and also a small amount (approximately 2 to 6%) of $N_2$ product at higher than rectifier 901 pressure.

Figure 10:
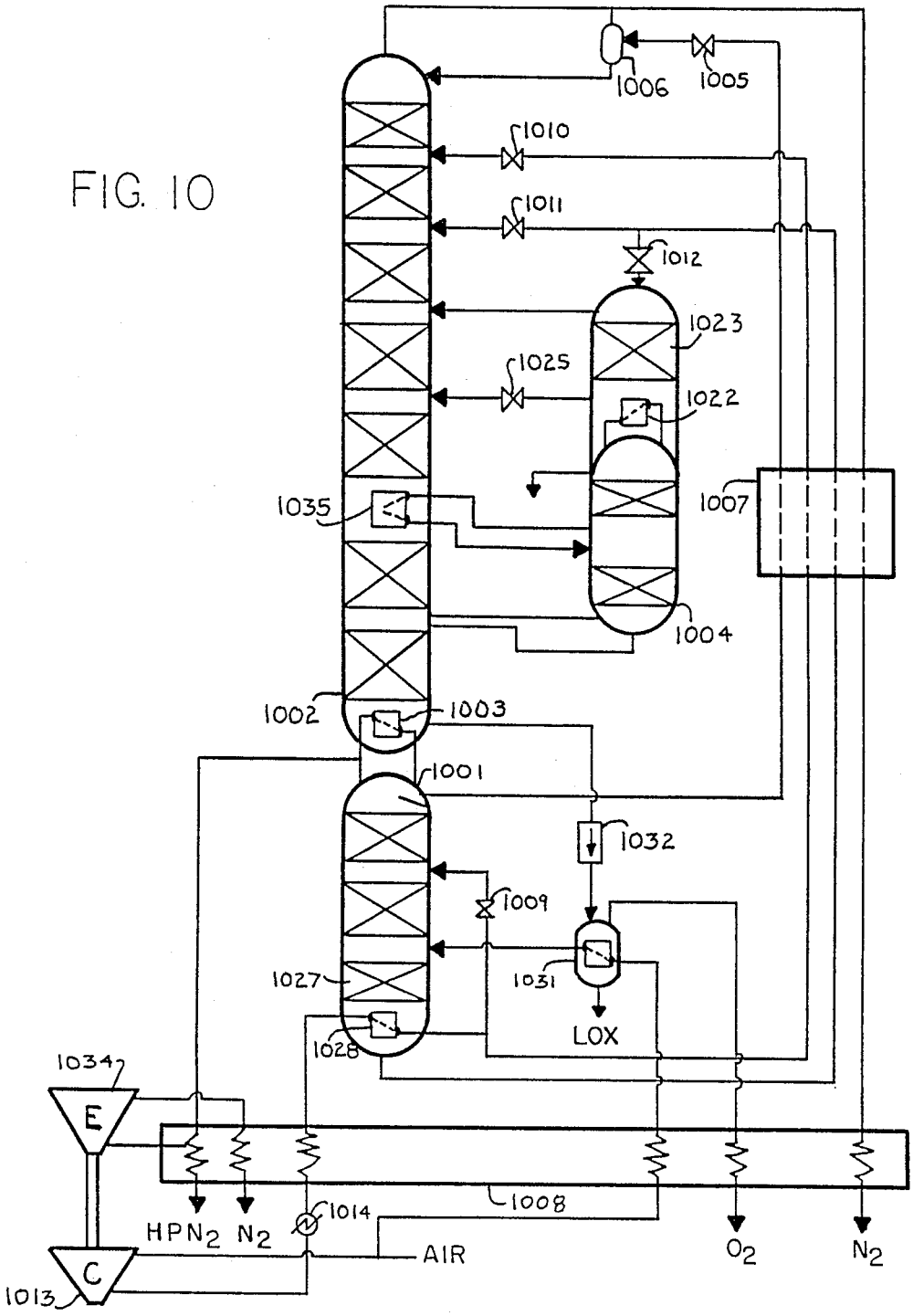

Referring to FIG. 10, the major fraction of supply air is first partially condensed in PC LOXBOIL evaporator 1031; HP rectifier 1001 bottom liquid is further enriched via TCRR using contact zone 1027 and air total condenser 1028; and HP rectifier $N_2$ is work-expanded in expander 1034 plus some may be withdrawn as coproduct. FIG. 10 illustrates another alternative means of maximizing crude argon production: directly exchanging latent heat between sidearm 1004 intermediate height vapor and LP column 1002 intermediate height liquid via heat exchanger 1035.

Figure 11:
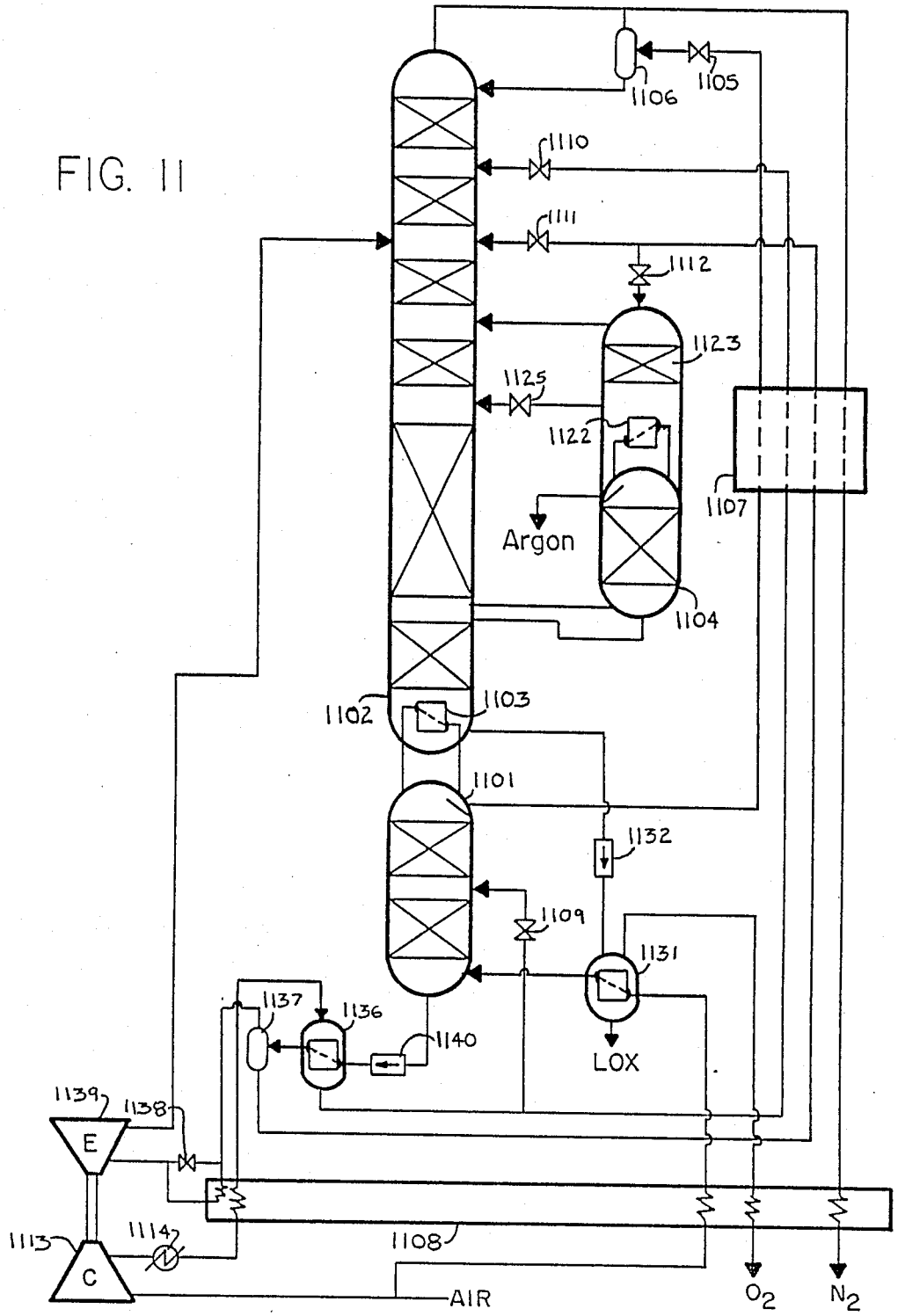

Referring to FIG. 11, the major air fraction once again is first used for PC LOXBOIL in evaporator 1131, and the minor air fraction, after optional compression in compressor 1113 and cooling in exchangers 1114 and 1108 is essentially totally condensed in KELBOIL evaporator 1136. Kelboil is supplied to evaporator 1136 via means for flow control 1140, which preferably effects a slight pressure increase. The two-phase mixture from evaporator 1136 is phase separated in separator 137, with the vapor being routed to work expansion in expander 1139 via controlled partial heat 1138, and the further enriched kettle liquid is fed to LP column 1102 via valves 1111 and 1112. The exhaust from expander 1139, at approximately the composition of air, is fed to LP column 1102 at approximately the same height as the enriched feed liquid.

Figure 12:
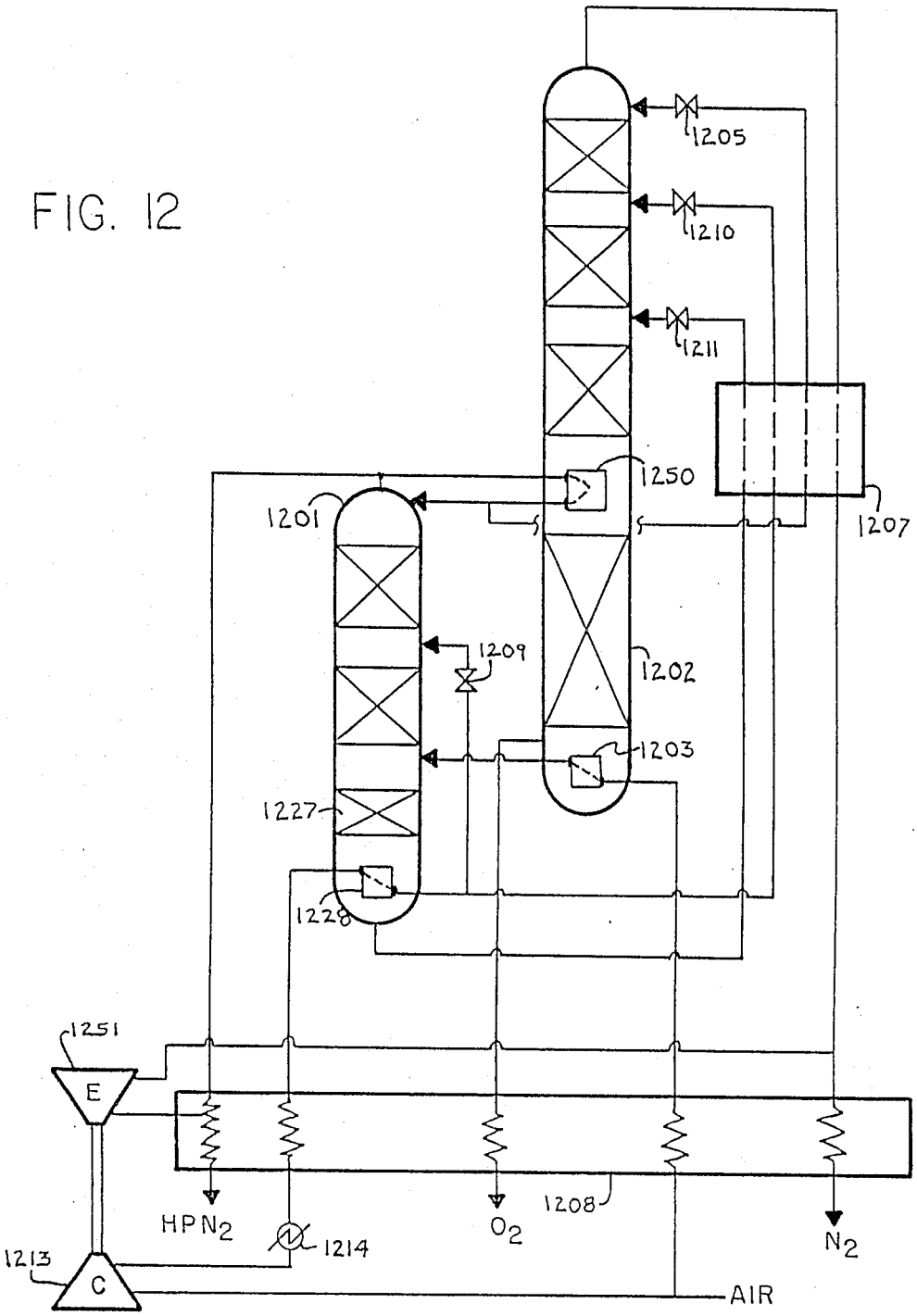
FIGS. 12 and 13 illustrate that the generic invention as applied to air separation is applicable to any product slate, not just high purity oxygen

Although all of the FIGS. 4 through 11 are directed toward production of high purity oxygen plus crude argon coproduct, the generic invention disclosed herein applies to any other product slate, for example low purity (95%) $O_2$ production or nitrogen production. FIG. 12 illustrates the preferred approach to low purity $O_2$ production incorporating TCRR, and FIG. 13 does the same for $N_2$ production.

Referring to FIG. 12, column 1201 incorporates a high pressure rectifying section and also contact zone 1227 and air total condenser 1228 for further enrichment of the rectifier bottom liquid. LP column 1202 is reboiled by partial condensation of the major fraction of supply air in reboiler 1203, and the partially condensed air is then fed to column 1201. The minor fraction of supply air is further compressed in compressor 1213, cooled in cooler 1214 and main heat exchanger 1208, and after condensation in condenser 1228 is split into respective intermediate height reflux streams for column 1201 via valve 1209 and for column 1202 via valve 1210. The enriched rectifier bottom liquid is fed to column 1202 through valve 1211 after subcooling in heat exchanger 1207, and product oxygen is evaporated by reboiler 1203 which doubles as a PC LOXBOILER. Column 1201 is refluxed by and provides intermediate reboil to column 1202 via latent heat exchanger 1250. Alternatively part of the kettle liquid could be evaporated in reflux condenser 1250, then fed as vapor to column 1202. In either embodiment the LIN overhead product is fed through valve 1205 to column 1202 as reflux therefor. Part of the high pressure $N_2$ is withdrawn as product, and process refrigeration may be provided in any known manner, e.g., by air expansion or by the illustrated expansion of part of the high pressure $N_2$ in work-expander 1251. The primary advantage of this flowsheet over other prior art disclosed low purity $O_2$ flowsheets which also obtain full $O_2$ recovery, high $O_2$ delivery pressure (e.g., by PC LOXBOIL), and low supply pressure (e.g., about 4.1 ATA) is that this flowsheet allows co-recovery of more pressurized $N_2$ either as product, or for liquids production, or for any other useful purpose.

Figure 13:
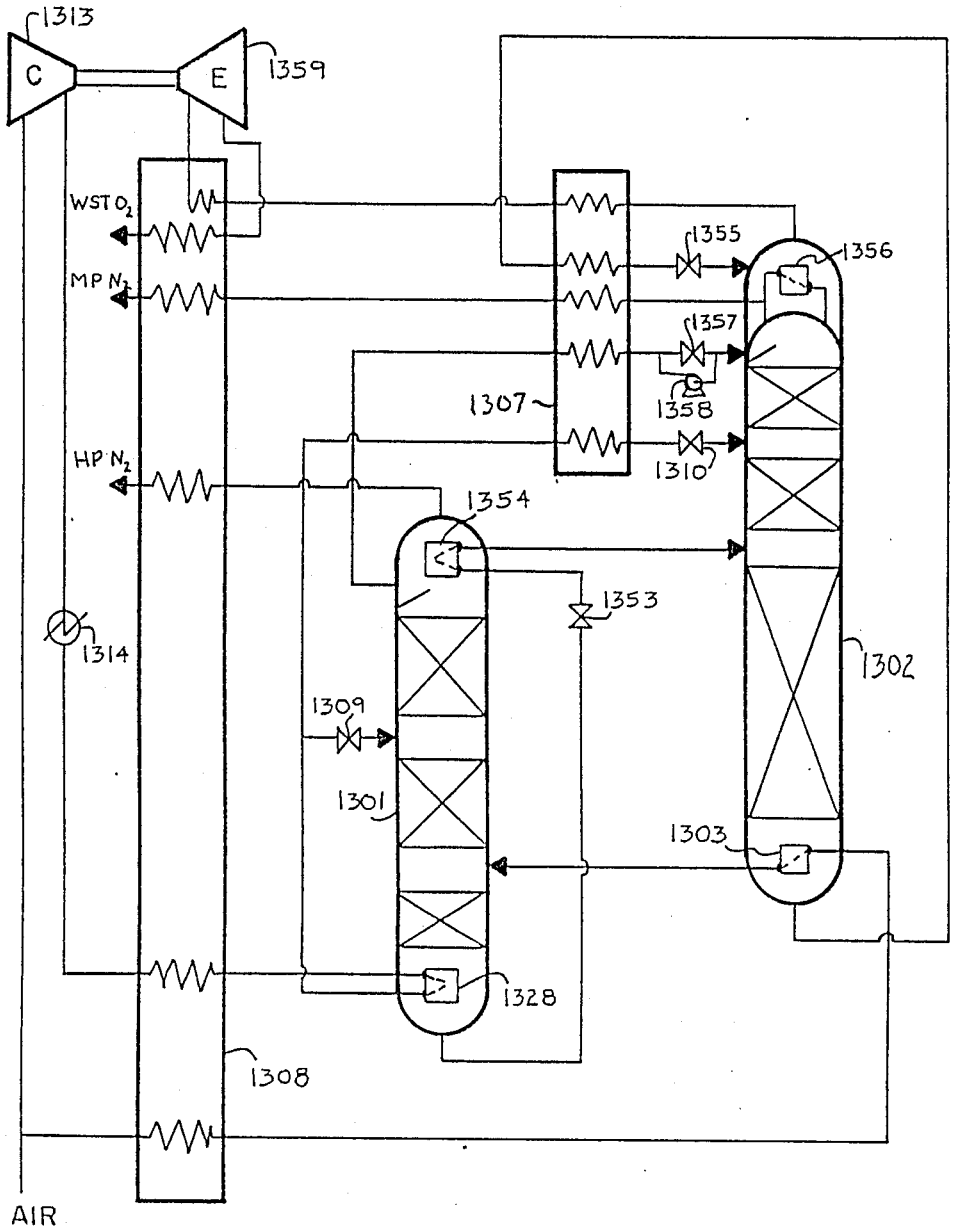

Referring to FIG. 13, the familiar TCRR/LAIRSPLIT cascade arrangement is employed consisting of HP column 1301; LP column 1302; LP column reboiler 1303 which is also the air total condenser; intermediate liquid air reflux control valves 1309 and 1310; and subcooler 1307. The minor fraction of supply air is further compressed in compressor 1313 and cooled in cooler 1314 and main heat exchanger 1308 before total condensation in condenser 1328. Condenser 1328 and contact zone 1327 achieve the maximum possible further enrichment o the rectifier 1301 bottom liquidfor a given work input at compressor 1313. The enriched bottom liquid is depressurized by valve 1353 to column 1302 pressure and is at least partially evaporatored in reflux condenser 1354 prior to feeding to column 1302. Alternatively the rectifier reflux scheme of FIG. 12 could be used. Although any known refrigeration technique can be utilized, the most efficient and lowest cost means is to subcool column 1302 bottom liquid in subcooler 1307, depressurize it to approximately 2 ATA (e.g., 1.5 to 3 ATA) with valve 1355, and totally evaporate it by reflux condenser 1356. Then the evaporated bottom liquid, with a composition of about 75 to 95% $O_2$ (usually about 85%) is partialy warmed and then work-expanded in expander 1359 for needed refrigeration. This refrigeration technique elevates the pressure of both columns so as to minimize the harmful effect of pressure drops, and reduce column sizes. The combination of producing LIN reflux at condenser 1356, plus the effect of TCRR/LAIRSPLIT which greatly reduces the LIN requirements, greatly reduces the amount of LIN reflux required through valve 1357. Indeed, is some embodiments it will be desired to transport reflux LIN in the opposite direction using LIN pump 1358. The overall net effect is, finally, to increase $N_2$ recovery to higher levels than with prior art disclosures, and secondly, to produce proportionately more of the product $N_2$ at column 1301 pressure in contrast to column 1302 pressure, thus reducing the additional compression requirements.

Although several generic embodiments have been presented, plus several more examples of application of the basic inventive entity to a specific separation (air separation), it will be recognized that these examples are in no way lmiting to the overall scope of the claimed invention. The large number of examples is intended to merely be indicative of the broad scope of the invention. Numerous additional modifications or obvious variations incorporating other known concepts will be apparent to the artisan. To cite only a few examples, the flowsheets may be adapted to all-liquids production; overhead $N_2$ from the HP rectifier may be withdrawn at two different purities by incorporating a few additional contact stages between the withdrawal points; various sensible heating/cooling configurations cabn be used; latent heat exchangers can be located either inside or external to the column they serve; other products may be withdrawn, e.g., tract LOX streams from the LP column sump containing the krypton and xenon values; and so on. The scope should only be limited by the claims.

The various latent heat exchanges referred to will normally unavoidably include some amount of sensible heat exchange. The additional compression of the minor feed fraction to be totally condensed, when required, may be accomplished via an independent, externally powered compressor in addition to or in lieu of a compander. There may be incorporated an additional higher pressure rectifier handling a higher pressure fraction of the feed gas, as disclosed in U.S. Pat. No. 4,604,116. In that event it would be preferred to divide the condensed feed into three intermediate reflux streams, one which would require pumping to the higher pressure rectifier. The additional high pressure $N_2$ made available by this invention may be work-expanded to power a cold compressor, e.g., to further increase the $O_2$ delivery pressure as in U.S. Pat. No. 4,357,153, or to heat pump the argon sidearm with a crude argon stream and hence increase argon recovery, as in U.S. Pat. No. 4,533,375.

I claim:

1. In a process for the subambient temperature fractional distillation of a fluid mixture comprising rectifying at least part of the feed at high pressure, distilling the rectified feed at a lower pressure, reboiling said distilling step by exchanging latent heat with vapor from said rectifiying step, and refluxing said distilling step with depressurized liquid from said latent heat exchanging step, the improvement comprising:

(a) essentially totally condensing a minor fraction of the feed, which is preferably at a pressure at least as high as the pressure of said rectifying step, by exchanging latent heat with a liquid from said rectifying step;

(b) splitting the condensed feed into at least two streams; and (c) intermediate refluxing said high pressure rectifying step with one of said streams and said low pressure distilling step with another.

2. Process according to claim 1 additionally comprising controlling the amount of feed totally condensed, and controlling split proportions of said condensed feed, so as to achieve a pinch condition at the intermediate reflux height and at least one feed height of both said rectifying step and said distilling step.

3. Process according to claim 1 additionally comprising increasing the pressure of said minor fraction of feed prior to said total condensing step.

4. Process according to claim 3 additionally comprising work-expanding at least part of one of the vapor streams associated with said distillation process, and applying the work generated thereby to power at least part of said pressure-increasing step.

5. Process according to claim 1 wherein said liquid from said rectifying step is overhead liquid.

6. Process according to claim 5 additionally comprising reducing the pressure of said overhead liquid and work-expanding said minor fraction of feed prior to said latent heat exchanging step between totally condensing feed and evaporating overhead liquid.

7. Process according to claim 5 additionally comprising increasing the pressure of said overhead liquid and increasing the pressure of said minor fraction of feed prior to said latent heat exchanging step between totally condensing feed and evaporating overhead liquid.

8. Process according to claim 1 wherein said liquid from said rectifying step is bottom liquid.

9. Process according to claim 8 additionally comprising reducing the pressure of said bottom liquid prior to said latent heat exchanging step with condensing feed; and work-expanding the resulting evaporated portion of said bottom liquid.

10. Process according to claim 8 additionally comprising returning the evaporated portion of said bottom liquid to said rectifying step, and increasing the pressure of said minor fraction of feed prior to said latent heat exchanging step.

11. Process according to claim 10 additionally comprising counter-currently contacting said bottom liquid enroute to said latent heat exchanging with totally condensing feed step with said evaporated bottom liquid returning to said rectifying step.

12. Process according to claim 1 wherein said feed fluid mixture is cleaned and compressed air.

13. In an apparatus for the subambient temperature fractional distillation of a fluid feed mixture comprising a high pressure (HP) rectifying section, and a low pressure (LP) distillation column including a reboiler for exchanging latent heat with HP rectifying section overhead vapor and for providing overhead reflux liquid to both said HP rectifying section and said LP distillation column, the improvement comprising:

(a) a means for essentially totally condensing a minor fraction of said feed mixture by exchanging latent heat with a liquid from said HP rectifying section;

(b) a means for splitting the condensed feed into at least two streams; and (c) a means for routing one of said strams to an intermediate reflux height of said HP rectifying section, and another to an intermediate reflux height of said LP distillation column.

14. The apparatus according to claim 13 wherein the HP rectifying section liquid supplied to said latent heat exchange is feed height liquid (also called bottom liquid), and additionally comprised of a compressor for increasing the pressure of said minor feed fraction prior to said total condensation.

15. The apparatus according to claim 14 additionally comprising:

(a) a means for returning the vapor effluent from said means for exchanging latent heat to said HP rectifying section; and (b) a work-expander which expands a cold vapor stream derived from said feed mixture and which provides at least part of the power necessary to drive said compressor.

16. The apparatus according to claim 14 additionally comprising a zone of counter-current vapor liquid contact which is in fluid contact with the bottom of said HP rectifying section and the top of said means for exchanging latent heat.

17. A process for fractionally distilling a supply of compressed and cleaned air to product oxygen and co-product nitrogen comprising:

(a) rectifying a major fraction of said supply air to liquid nitrogen (LIN) overhead product and oxygen-enriched liquid bottom product in a high pressure rectifier;

(b) evaporating part of said LIN by exchanging latent heat with a minor fraction of said supply air, which is essentially totally condensed thereby;

(c) distilling said bottom product in a $N_2$ removal column; and (d) refluxing intermediate heights of said HP rectifier and said $N_2$ removal column with the liquid air from step (b).

18. The process according to claim 17 wherein said minor fraction is comprised of between about 8% and 21% of said supply air.

19. The process according to claim 18 further comprising decreasing the pressure of said LIN below HP rectifier pressure prior to said evaporation.

20. The process according to claim 18 further comprising increasing the pressure of said LIN prior to said evaporation.

21. The process according to claim 18 further comprising partially warming and work-expanding said evaporated $N_2$.

22. The process according to claim 18 further comprising partially cooling and work-expanding said minor fraction of suppy air prior to said total condensation.

23. The process according to claim 18 further comprising additionally compressing said minor fraction of supply air to above supply air pressure prior to said total condensation.

24. The process according to claim 22 further comprising additionally compressing said minor fraction of supply air prior to said partial cooling; and providing at least part of the power for said compression from said work-expansion.

25. The process according to claim 18 further comprising additionally distilling the oxygen-argon mixture from said nitrogen removing distillation step so as to yield high purity oxygen and crude argon.

26. The process according to claim 25 further comprised of:

(a) providing overhead reflux to said argon-oxygen distillation step by exchanging latent heat with at least one of:

(i) a separate stream of partially depressurized $LN_2$ from said HP rectifier;

(ii) intermediate reboil height liquid from said $N_2$ removal column; and (iii) the unevaporated remainder of HP rectifier bottom liquid after it has been depressurized and partially evaporated.

27. The process according to claim 22 wherein said air undergoing total condensation is at a lower pressure than said HP rectifier pressure, and further comprising increasing the pressure of the liquid air enroute to intermediate refluxing of said HP rectifier.

28. An apparatus for producing oxygen and nitrogen by fractional distillation of a supply of compressed and cleaed air comprising:

(a) a high pressure (HP) rectifier;

(b) a low pressure column including a reboiler/reflux condenser for exchanging latent heat between HP rectifier vapor and LP column liquid;

(c) an evaporator for evaporating part of the overhead product liquid nitrogen (LIN) from said HP rectifier by exchanging latent heat with a minor fraction of said supply air; and (d) a means for withdrawing liquid air from said evaporator and splitting it into separate intermediate height reflux streams for said HP rectifier and said LP column.

29. The apparatus according to claim 28 further comprised of at least one of:

(a) a means for reducing the pressure of the LIN supply to said evaporator to below said HP rectifier pressure; and (b) a means for partially cooling and work-expanding said minor fraction of supply air before routing it to said evaporator.

30. The apparatus according to claim 28 further comprised of at least one of:

(a) a means for increasing the pressure of the LIN supply to said evaporator to above said HP rectifier pressure; and (b) a means for partially warming and work-expanding the evaporated $N_2$ from said evaporator.

31. The apparatus according to claim 28 further comprised of at least one of:

(a) a means for additionally compressing said minor fraction of supply air; and (b) a means for work-expanding a vapor stream so as to supply at least part of said additional compression power.

32. A process for the subambient fractional distillation of a supply of pressurized feed gas mixture comprising:

(a) providing at least one high pressure (HP) fractionating column comprised of at least one rectifying section, at least one stripping section, a reboiler, and at least one reflux condenser;

(b) providing at least one low pressure (LP) distillation column which receives enriched feed mixture from said HP column;

(c) increasing the pressure of a minor fraction of the supply mixture;

(d) essentially totally condensing said increased-pressure fraction in said reboiler; and (e) splitting the condensed feed into at least two intermediate reflux streams, one for said HP column and another for said LP column.

33. The process according to claim 32 additionally comprising controlling the amount of feed mixture which is totally and condensed and controlling the intermediate reflux split proportions so as to achieve a pinch condition at both the intermediate reflux heights and the feed heights of said HP and LP columns.

34. The process according to claim 32 wherein the feed mixture is air and wherein said minor fraction comprises between about 8% and B; 21% of said supply air.

35. The process according to claim 34 additionally comprising work-expanding a cooled vapor stream derived from said supply air; and directly driving a compressor with the resulting work to provide said pressure increase.

36. The process according to claim 32 additionally comprising partially condensing a major fraction of said supply air by exchanging latent heat with LP column bottom liquid and then feeding the partially condensed air to said HP column.

37. The process according to claim 36 wherein said supply mixture is air and additionally comprising:

(a) refluxing the overhead of said HP column by exchanging latent heat with bottom liquid of an argon-oxygen distillation column;

(b) feeding said argon-oxygen distillation column with a liquid withdrawn from an intermediate height below the feed height of said LP column; and (c) withdrawing product high purity gaseous oxygen from the sump of said LP column.

38. The process according to claim 36 wherein said supply mixture is air and additionally comprising:

(a) refluxing the overhead of said HP column by exchanging latent heat with at leat one of:

(i) LP column intermediate height liquid; and (ii) at least part of the depressurized bottom product from said HP column; and (b) withdrawing product gaseous low purity oxygen from the sump of said LP column.

39. The process according to claim 34 additionally comprising:

(a) refluxing the overhead of said HP column by exchanging latent heat with LP column bottom liquid and reboiling the LP column thereby; and (b) providing part of the reflux to an argon sidearm incorporated as part of said LP column by exchanging latent heat with part of the liquid nitrogen overhead product from said HP column.

40. The process according to claim 36 wherein said supply mixture is air and additionally comprising:

(a) refluxing the overhead of said HP column by exchanging latent heat with at least one of:

(i) LP column intermediate height liquid; and (ii) at least part of the depressurized bottom product from said HP column;

(b) refluxing the overhead of said LP column at least in part by exchanging latent heat with depressurized LP column bottom liquid; and (c) withdrawing product gaseous nitrogen from the overheads of both columns.

* * * * *